US005981923A

United States Patent [19]

Jackson

[11] Patent Number: 5,981,923

[45] Date of Patent: Nov. 9, 1999

[54] MICROWAVE MOISTENED TOWELETTE HEATING DEVICE

[76] Inventor: Walter F. Jackson, 12509 Sunrise Dr. NE., Bainbridge Island, Wash. 98110

[21] Appl. No.: 09/262,204

[22] Filed: Mar. 4, 1999

[51] Int. Cl.[6] ..... H05B 6/80

[52] U.S. Cl. ..... 219/679; 219/756; 219/762; 219/388; 219/521; 221/150 A; 414/208

[58] Field of Search ..... 219/679, 756, 219/762, 698, 693, 385, 388, 521; 221/150 A, 150 HC; 414/160, 208

[56] References Cited

U.S. PATENT DOCUMENTS 3,482,509 12/1969 Gardner ..... 219/679
3,710,978 1/1973 Cosby ..... 221/150 A
5,231,266 7/1993 Warren ..... 219/521
5,611,954 3/1997 Wright ..... 219/759

*Primary Examiner*—Philip H. Leung

[57] ABSTRACT

A moistened towelette heating device for providing a moist hot towel for washing a user's body. The moistened towelette heating device includes a housing with a depression in the top of the housing forming a chute. The chute has an opening into a passage in the housing which, in turn, is connected to microwave oven disposed in the housing. The housing has a main opening into the microwave oven and an access door substantially closing the main opening. A plurality of canisters each with a moistened towelette disposed therein are positioned in the chute to permit passage of each canister through the passage and into the microwave oven where the canister may be heated to heat the towelette therein.

10 Claims, 2 Drawing Sheets

MICROWAVE MOISTENED TOWELETTE HEATING DEVICE

BACKGROUND OF THE INVENTION

1. Field of the Invention

The present invention relates to machines for producing hot steamed towels and more particularly pertains to a new moistened towelette heating device for providing a moist hot towel for washing a user's body.

2. Description of the Prior Art

The use of machines for producing hot steamed towels is known in the prior art. More specifically, machines for producing hot steamed towels heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,457,389—a heater for towels by Knapp; U.S. Pat. No. 5,378,876—a fail safe microwave oven by Kitagawa; U.S. Pat. No. Des. 302,584—a towelette warmer by DeMars; U.S. Pat. No. 5,231,266—a towelette warmer by Warren; U.S. Pat. No. 4,890,205—a combined night light and pre-moistened towellette warmer by Shaffer; and U.S. Pat. No. 4,700,048—a heating attachment for towelettes by Levy which are all incorporated by reference herein.

While these devices fulfill their respective, particular objectives and requirements, the aforementioned patents do not disclose a new moistened towelette heating device. The inventive device includes a housing with a depression in the top of the housing forming a chute. The chute has an opening into a passage in the housing which, in turn, is connected to microwave oven disposed in the housing. The housing has a main opening into the microwave oven and an access door substantially closing the main opening. A plurality of canisters each with a moistened towelette disposed therein are positioned in the chute to permit passage of each canister through the passage and into the microwave oven where the canister may be heated to heat the towelette therein.

In these respects, the moistened towelette heating device according to the present invention substantially departs from the conventional concepts and designs of the prior art, and in so doing provides an apparatus primarily developed for the purpose of providing a moist hot towel for washing a user's body.

SUMMARY OF THE INVENTION

In view of the foregoing disadvantages inherent in the known types of machines for producing hot steamed towels now present in the prior art, the present invention provides a new moistened towelette heating device construction wherein the same can be utilized for providing a moist hot towel for washing a user's body.

The general purpose of the present invention, which will be described subsequently in greater detail, is to provide a new moistened towelette heating device apparatus and method which has many of the advantages of the machines for producing hot steamed towels mentioned heretofore and many novel features that result in a new moistened towelette heating device which is not anticipated, rendered obvious, suggested, or even implied by any of the prior art machines for producing hot steamed towels, either alone or in any combination thereof.

To attain this, the present invention generally comprises a housing with a depression in the top of the housing forming a chute. The chute has an opening into a passage in the housing which, in turn, is connected to microwave oven disposed in the housing. The housing has a main opening into the microwave oven and an access door substantially closing the main opening. A plurality of canisters each with a moistened towelette disposed therein are positioned in the chute to permit passage of each canister through the passage and into the microwave oven where the canister may be heated to heat the towelette therein.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new moistened towelette heating device apparatus and method which has many of the advantages of the machines for producing hot steamed towels mentioned heretofore and many novel features that result in a new moistened towelette heating device which is not anticipated, rendered obvious, suggested, or even implied by any of the prior art machines for producing hot steamed towels, either alone or in any combination thereof.

It is another object of the present invention to provide a new moistened towelette heating device which may be easily and efficiently manufactured and marketed.

It is a further object of the present invention to provide a new moistened towelette heating device which is of a durable and reliable construction.

An even further object of the present invention is to provide a new moistened towelette heating device which is susceptible of a low cost of manufacture with regard to both materials and labor, and which accordingly is then susceptible of low prices of sale to the consuming public, thereby making such moistened towelette heating device economically available to the buying public.

Still yet another object of the present invention is to provide a new moistened towelette heating device which provides in the apparatuses and methods of the prior art some of the advantages thereof, while simultaneously overcoming some of the disadvantages normally associated therewith.

Still another object of the present invention is to provide a new moistened towelette heating device for providing a moist hot towel for washing a user's body.

Yet another object of the present invention is to provide a new moistened towelette heating device which includes a housing with a depression in the top of the housing forming a chute. The chute has an opening into a passage in the housing which, in turn, is connected to microwave oven disposed in the housing. The housing has a main opening into the microwave oven and an access door substantially closing the main opening. A plurality of canisters each with a moistened towelette disposed therein are positioned in the chute to permit passage of each canister through the passage and into the microwave oven where the canister may be heated to heat the towelette therein.

Still yet another object of the present invention is to provide a new moistened towelette heating device that can warm several moistened towelettes very quickly.

Even still another object of the present invention is to provide a new moistened towelette heating device that comes in a housing that may be placed for example in a home, an office and even an airplane.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
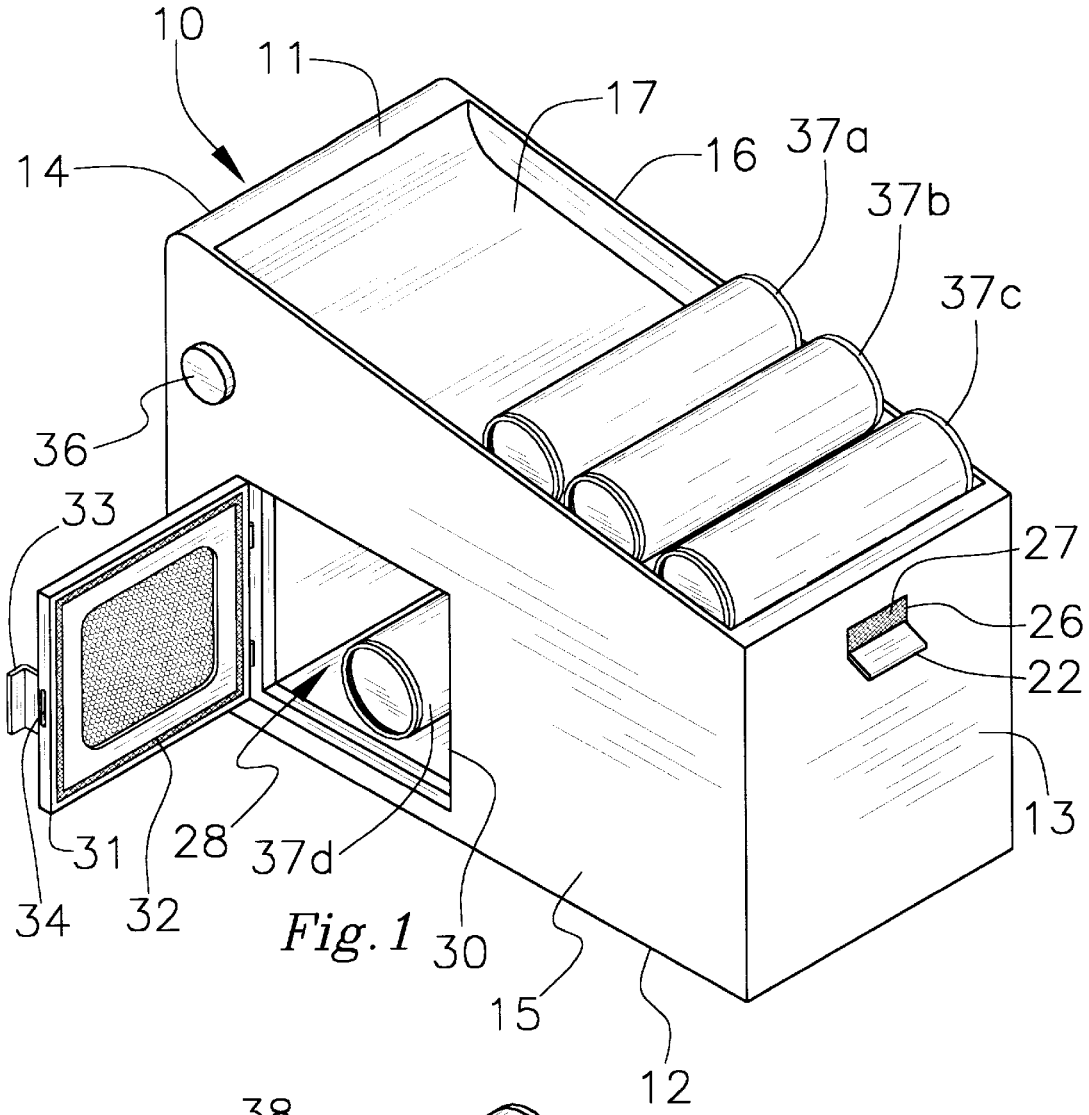
FIG. 1 is a schematic perspective view of a new moistened towelette heating device according to the present invention.

With reference now to the drawings, and in particular to FIGS. 1 through 4 thereof, a new moistened towelette heating device embodying the principles and concepts of the present invention will be described.

As best illustrated in FIGS. 1 through 4, the moistened towelette heating device generally comprises a housing with a depression in the top of the housing forming a chute. The chute has an opening into a passage in the housing which, in turn, is connected to microwave oven disposed in the housing. The housing has a main opening into the microwave oven and an access door substantially closing the main opening. A plurality of canisters each with a moistened towelette disposed therein are positioned in the chute to permit passage of each canister through the passage and into the microwave oven where the canister may be heated to heat the towelette therein.

In closer detail, the device comprises a housing 10 with a top 11, a bottom 12, a pair of ends 13,14 and a pair of sides 15,16 between the ends of the housing.

The top of the housing has a depression forming an inclined chute 17. The length of the chute is extended between the ends of the housing. The chute is inclined towards a first of the ends 13 of the housing from a second of the ends of the housing. Preferably, the incline of the chute is between about 3 degrees and 20 degrees from a horizontal plane. Ideally, the incline of the chute is about 10 degrees.

The chute has an opening 18 adjacent the first end of the housing into an L- or elbow-shaped passage 19 in the housing. Preferably, the passage has upper and lower portions 20,21. The upper portion 20 of the passage is positioned adjacent the first end of the housing and is extended from the opening of the chute towards the bottom of the housing. The lower portion 21 of the passage is positioned adjacent the bottom of the housing and extending between the upper portion of the passage towards a second of the ends 14 of the housing.

A trap door 22 substantially closing the opening 18 of the chute into the passage 19. As best illustrated in FIG. 4, the trap door is pivotally mounted to the housing to permit pivoting of the trap door between a closed position (see FIG. 3) where the trap door closes the opening of the chute and an open position (see FIG. 4) where the opening of the chute is generally unblocked by the trap door. The trap door is preferably biased towards the closed position. Ideally, a spring 23 biases the trap door towards the closed position.

Preferably, the opening of the chute has a resiliently deformable gasket 24 therearound to form a seal between the trap door and the opening of the chute when the trap door is positioned in the closed position.

The trap door has a lever 25 outwardly extending from a slot 26 through the first end of the housing. In use, the lever is designed for permitting a user to selectively pivot the trap door between the open and closed positions with their fingers. Preferably, the slot of the first end of the housing has an resiliently deformable seal 27 around the lever to substantially closing the slot while still allowing movement of the lever in the slot to permit pivoting of the trap door with the lever between the open and closed positions.

A microwave oven 28 is disposed in the housing. Preferably, the microwave housing is positioned adjacent the bottom of the housing and towards the second end of the housing. The lower portion of the passage has an opening 29 into the microwave oven to permit passage of objects between the passage and the microwave oven.

A first of the sides 15 of the housing has a main opening 30 into the microwave oven. An access door 31 is pivotally mounted to the first side of the housing and substantially closes the main opening into the microwave oven. The access door ideally has a resiliently deformable gasket 32 to provide a seal between the access door and the first side of the housing when the access door closes the main opening.

The access door also preferably has a handle 33 with a latch mechanism 34 for releasably holding the access door in the position where the access door substantially closes the main opening.

The microwave oven has a switch 35 for selectively activating the microwave oven to heat an object in the microwave oven. The switch has an actuator 36 such as a push button actuator for permitting a user to selectively activate the switch. The actuator is preferably mounted to the first side 15 of the housing and ideally positioned adjacent the second end 14 of the housing.

A plurality of generally cylindrical canisters 37*a*,37*b*,37*c*, 37*d* are provided each having an end opening 38 and a cap 39 substantially covering the end opening of the respective canister. Inside each canister is a water moistened towelette 40 or towel (preferably made of a terry towel type of fabric) disposed therein.

Figure 3:
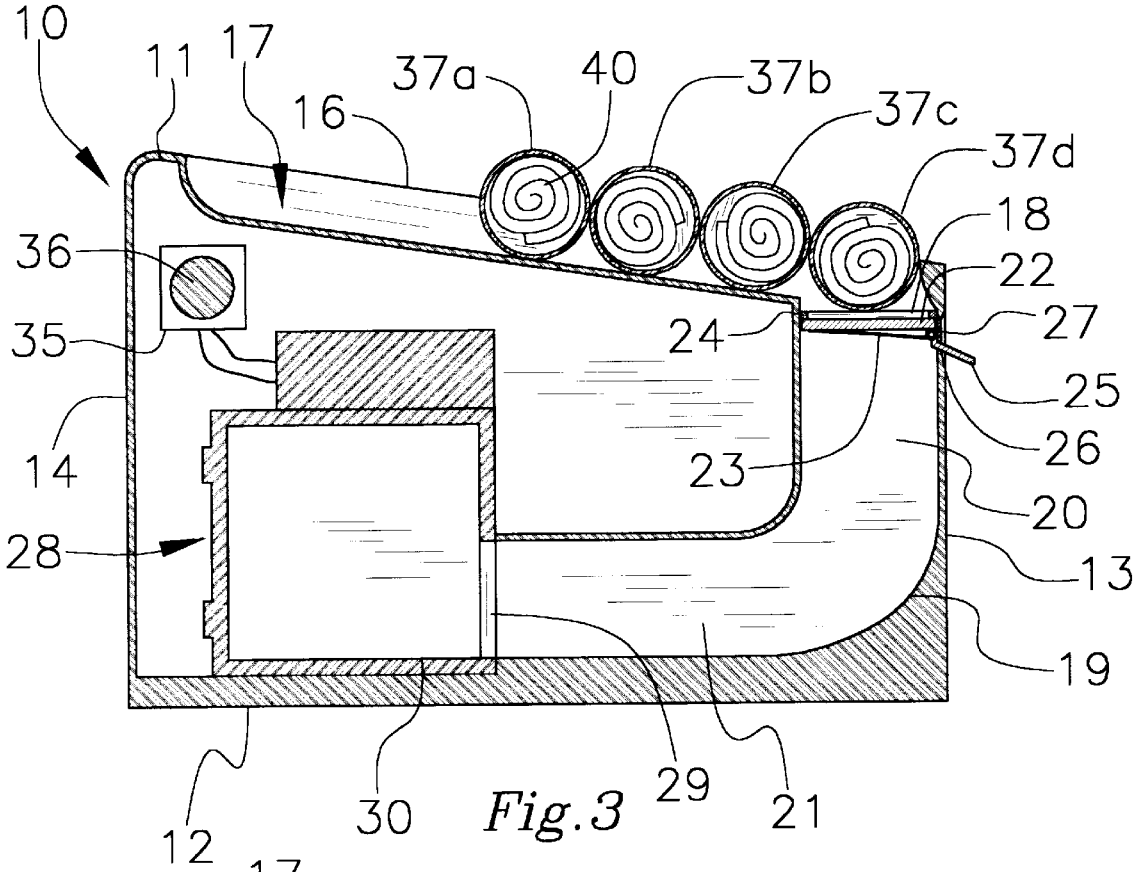
FIG. 3 is a schematic cross sectional view of the present invention with the trap door in the closed position.
Figure 4:
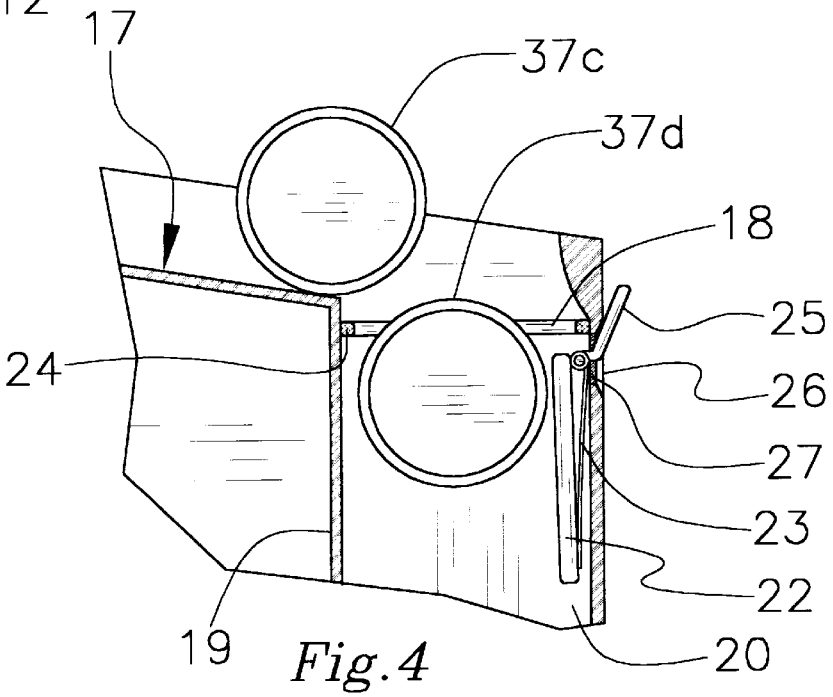
FIG. 4 is a schematic enlarged cross sectional view of the trap door region with the trap door in an open position to permit passage of a canister from the chute into the passage to the microwave oven.

In use, the canisters are first positioned in the chute so that the incline of the chute rolls the canisters towards the first end of the housing end of the chute as shown in FIGS. 1 and 3. Pivoting of the trap door from the closed position to the open position permits at least one of the canisters to fall through the opening into the passage (as illustrated in FIG. 4) and roll through the passage into the microwave oven via the opening between the passage and the microwave oven. More than one canister may be permitted to fall into the passage if desired by holding the trap door in the open position until the desired number of canister roll down the chute and into the passage.

Figure 2:
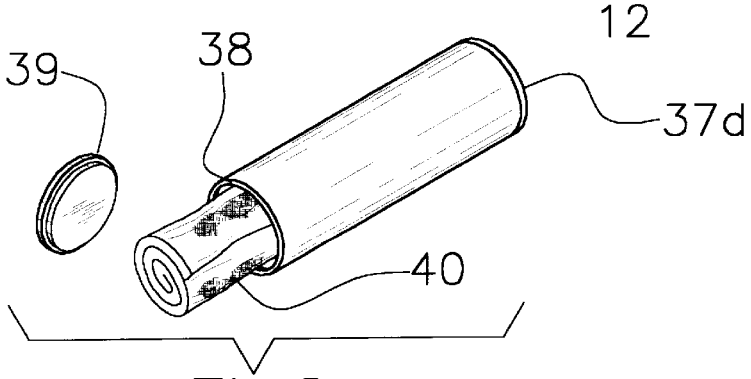
FIG. 2 is a schematic perspective view of a canister with its cap removed to reveal the towelette therein.

Once the canisters reach the microwave oven, the actuator is then depressed to activate the microwave oven to heat the moistened towelettes in the canisters in the microwave oven. After the towelettes have been heated, the access door may be opened to remove the canisters. As illustrated in FIG. 2, the cap of each canister is then removed to permit removal of the now heated moistened towelette from the canister.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A device for heating moistened towelettes, comprising:

a housing having a top, said top of said housing having a depression forming a chute;

said chute having an opening into a passage in said housing;

a microwave oven being disposed in said housing, said passage having an opening into said microwave oven;

said housing having a main opening into said microwave oven and an access door substantially closing said main opening; and a plurality of canisters each having a moistened towelette disposed therein, said canisters being positioned in said chute.

2. The device of claim 1, wherein said housing has a bottom, a pair of ends and a pair of sides between said ends of said housing, wherein said chute is extended between said ends of said housing, wherein said chute is inclined towards a first of said ends of said housing, and wherein said opening of said chute into said passage is located adjacent said first end of said housing.

3. The device of claim 2, wherein said passage has upper and lower portions, said upper portion of said passage being positioned adjacent said first end of said housing and being extended from said opening of said chute towards said bottom of said housing, said lower portion of said passage being positioned adjacent said bottom of said housing and extending between said upper portion of said passage towards a second of said ends of said housing.

4. The device of claim 1, further comprising a trap door substantially closing said opening of said chute into said passage.

5. The device of claim 4, wherein said trap door is pivotally mounted to said housing to permit pivoting of said trap door between a closed position where said trap door closes said opening of said chute and an open position where said opening of said chute is generally unblocked by said trap door.

6. The device of claim 5, wherein said trap door is biased towards said closed position.

7. The device of claim 5, wherein said trap door has a lever outwardly extending from said first end of said housing, said lever being adapted for permitting a user to selectively pivot said trap door between said open and closed positions.

8. The device of claim 1, wherein said microwave oven has a switch for selectively activating said microwave oven to heat an object in said microwave oven, said switch having an actuator mounted to said housing.

9. The device of claim 1, wherein each of said canisters has an end opening and a cap substantially covering the end opening of the respective canister.

10. A device for heating moistened towelettes, comprising:

a housing having a top, a bottom, a pair of ends and a pair of sides between said ends of said housing;

said top of said housing having a depression forming a chute, said chute being extended between said ends of said housing, said chute being inclined towards a first of said ends of said housing;

said chute having an opening adjacent said first end of said housing into a passage in said housing;

said passage having upper and lower portions, said upper portion of said passage being positioned adjacent said first end of said housing and being extended from said opening of said chute towards said bottom of said housing, said lower portion of said passage being positioned adjacent said bottom of said housing and extending between said upper portion of said passage towards a second of said ends of said housing;

a trap door substantially closing said opening of said chute into said passage, said trap door being pivotally mounted to said housing to permit pivoting of said trap door between a closed position where said trap door closes said opening of said chute and an open position where said opening of said chute is generally unblocked by said trap door;

said trap door being biased towards said closed position, wherein a spring biases said trap door towards said closed position;

said opening of said chute having a resiliently deformable gasket therearound to form a seal between said trap door and said opening of said chute when said trap door is positioned in said closed position;

said trap door having a lever outwardly extending from a slot through said first end of said housing, said lever being adapted for permitting a user to selectively pivot said trap door between said open and closed positions;

said slot of said first end of said housing having an resiliently deformable seal around said lever substantially closing said slot;

a microwave oven being disposed in said housing, said microwave housing being positioned adjacent said bottom of said housing and towards said second end of said housing, said lower portion of said passage having an opening into said microwave oven;

a first of said sides of said housing having a main opening into said microwave oven, an access door being pivotally mounted to said first side of said housing and substantially closing said main opening into said microwave oven, said access door having a latch mechanism for releasably holding said access door in the position where said access door substantially closes said main opening;

said microwave oven having a switch for selectively activating said microwave oven to heat an object in said microwave oven, said switch having an actuator, said actuator being mounted to said first side of said housing, said actuator being positioned adjacent said second end of said housing;

a plurality of generally cylindrical canisters each having an end opening and a cap substantially covering the end opening of the respective canister;

each canister having a moistened towelette disposed therein; and said canisters being positioned in said chute.

* * * * *